US011058229B2

(12) United States Patent
Salazar et al.

(10) Patent No.: US 11,058,229 B2
(45) Date of Patent: Jul. 13, 2021

(54) EXPANDABLE SEAT INFANT CARRIER

(71) Applicant: Blue Box Toy Factory Limited, Kowloon (HK)

(72) Inventors: Maureen O'Connor Salazar, Chicago, IL (US); Stacy Alycia Thomas Castro, Verona, WI (US); Leslie Ann Roeder, New York, NY (US)

(73) Assignee: BLUE BOX TOY FACTORY LIMITED, Kowloon (HK)

( * ) Notice: Subject to any disclaimer, the term of this patent is extended or adjusted under 35 U.S.C. 154(b) by 184 days.

(21) Appl. No.: 15/841,800

(22) Filed: Dec. 14, 2017

(65) Prior Publication Data

US 2018/0184813 A1 Jul. 5, 2018

Related U.S. Application Data

(60) Provisional application No. 62/440,085, filed on Dec. 29, 2016.

(51) Int. Cl.
*A47D 13/02* (2006.01)

(52) U.S. Cl.
CPC ..... *A47D 13/025* (2013.01)

(58) Field of Classification Search
CPC . A47D 13/025; A47D 13/02; A41D 2400/482
USPC ..... 224/158, 159, 160, 647–648
See application file for complete search history.

(56) References Cited

U.S. PATENT DOCUMENTS 4,234,229 A 11/1980 Arnold
4,402,440 A 9/1983 Purtzer et al.
4,434,920 A 3/1984 Moore
4,469,259 A 9/1984 Krich et al.
D276,478 S 11/1984 Fallon
4,492,326 A 1/1985 Storm
4,986,458 A 1/1991 Linday
5,361,952 A 11/1994 Gold
5,522,528 A 6/1996 Petricola
5,570,823 A 11/1996 Lindy
5,673,828 A 10/1997 Raedel et al.
5,813,580 A 9/1998 Fair
6,318,608 B1 11/2001 Fowler et al.
6,415,969 B1 7/2002 Higuchi
7,252,214 B2 8/2007 Krogh
7,284,503 B2 10/2007 Elmberg
7,766,199 B1 8/2010 Caperon
7,886,946 B2 2/2011 Gray
8,028,871 B2 10/2011 Gray
8,172,116 B1 5/2012 Lehan et al.
8,365,325 B2 2/2013 Schneider
8,424,732 B1 4/2013 Lehan et al.
8,453,894 B2 6/2013 Jung et al.
8,590,757 B2 11/2013 Frost
(Continued)

FOREIGN PATENT DOCUMENTS

EP 2810587 A1 * 12/2014 ..... A47D 13/025

*Primary Examiner* — Nathan J Newhouse
*Assistant Examiner* — Matthew T Theis
(74) *Attorney, Agent, or Firm* — Stetina Brunda Garred and Brucker; Mark B. Garred

(57) ABSTRACT

An adjustable infant carrier which is outfitted with conversion flaps adapted to allow for selective adjustability to the effective width of the seat portion of the carrier so as to accommodate children of differing size, as well as different support positions/configurations.

20 Claims, 3 Drawing Sheets

(56) References Cited

U.S. PATENT DOCUMENTS

| | | | | |
|---|---|---|---|---|
| 8,701,949 | B1 | 4/2014 | Lehan et al. | |
| 8,752,739 | B2 * | 6/2014 | Bergkvist | A47D 13/025 224/158 |
| 9,022,260 | B2 | 5/2015 | Frost | |
| 9,185,993 | B2 | 11/2015 | Telford et al. | |
| 2007/0029356 | A1 | 2/2007 | Moriguchi et al. | |
| 2008/0283559 | A1 | 11/2008 | Parness et al. | |
| 2009/0101683 | A1 | 4/2009 | Gilboa et al. | |
| 2010/0147910 | A1 | 6/2010 | Schachtner | |
| 2010/0308088 | A1 * | 12/2010 | Lindblom | A47D 13/025 224/160 |
| 2011/0042429 | A1 | 2/2011 | Frost | |
| 2011/0101051 | A1 | 5/2011 | Parness et al. | |
| 2011/0290831 | A1 | 12/2011 | Wang | |
| 2012/0199619 | A1 | 8/2012 | Zack | |
| 2013/0023810 | A1 | 1/2013 | Schmid et al. | |
| 2013/0284783 | A1 | 10/2013 | Burpee | |
| 2014/0263491 | A1 | 9/2014 | Telford et al. | |
| 2014/0284361 | A1 | 9/2014 | Wang | |
| 2018/0199730 | A1 * | 7/2018 | Lundh | A47D 13/025 |

* cited by examiner

EXPANDABLE SEAT INFANT CARRIER

CROSS-REFERENCE TO RELATED APPLICATIONS

The present application claims priority to U.S. Provisional Patent Application Ser. No. 62/440,085 entitled Expandable Seat Infant Carrier filed Dec. 29, 2016, the disclosure of which is incorporated herein by reference.

STATEMENT RE: FEDERALLY SPONSORED RESEARCH/DEVELOPMENT

Not Applicable

BACKGROUND

1. Technical Field

The present disclosure generally relates to an infant carrier and, more particularly, to an infant carrier which is outfitted with a selectively deployable flap arrangement to allow for adjustability to the effective width of the seat portion of the carrier.

2. Description of the Related Art

It is common practice for parents and other caregivers to carry infants and toddlers, and there is a variety of well-known infant carrier products in the prior art which are configured to be worn by an adult for on-the-body carrying of the infant or toddler. These products include slings, wraps, pouches, and backpack-like devices outfitted with shoulder strap devices in varying configurations and arrangements. Shoulder-supported infant carriers are particularly growing in popularity for supporting or transporting an infant or young child. A common attribute of these carriers is that they typically offer "hands free" operation, and allow the adult wearer to carry the infant while performing other activities. Therefore, shoulder-supported infant carriers typically provide immediate benefits to the parent/caregiver, including the freedom to use both hands while monitoring and caring for the child being carried. Care may be provided to other children simultaneously, strain and fatigue on the arms, back, and shoulders may be reduced, and household chores may be completed while monitoring the child. Moreover, cumbersome and bulky strollers need not be deployed in places such as crowded city sidewalks and public transportation systems.

Shoulder supported infant carriers, as currently known in the art, come in a wide range of designs and styles. One currently known infant carrier is a frame-type carrier which typically supports the infant on the back of the wearer. Currently, more popular than frame-type carriers, are frameless or soft-sided carriers which typically provide more comfort to the wearer and the infant, and are typically used to carry the infant of the front or chest of the wearer.

Although soft-sided carriers have become a popular means for transporting an infant, most soft-sided carriers suffer from one or more drawbacks. For instance, one common drawback associated with conventional soft-sided carriers is that the seat portion of the carrier is of a fixed size. Therefore, as the infant grows, the seat portion of the carrier may become too small, or when the infant is young, the seat portion of the carrier may be configured to support a larger infant, and thus, may be too big. Furthermore, the fixed nature of the seat portion on conventional infant carriers may limit the adaptability achievable by the infant carriers, i.e., the infant carrier may not be easily or comfortably adaptable in both front carry and rear carry configurations. The infant carrier described below addresses this drawback through its inclusion of a selectively deployable flap arrangement adapted to allow for adjustability to the effective width of the seat portion of the carrier in a quick and easy manner. These and other aspects of the present infant carrier will be discussed in more detail below.

BRIEF SUMMARY

Various aspects of the present disclosure are directed toward an adjustable infant carrier which is outfitted with a selectively deployable flap arrangement adapted to allow for the adjustability to the effective width of the seat portion of the carrier so as to accommodate children of differing size, as well as different support positions/configurations.

According to one embodiment of the present disclosure, the adjustable infant carrier comprises a main body panel defining a seat portion, a head portion, a central portion between the seat and head portions, and a pair of generally triangular conversion flaps which protrude from the seat portion in opposed relation to each other. The carrier further comprises a bib panel and an elongate waist belt which is extensible about the waist of a wearer. The lower ends of both the main body and bib panels are attached to the waist belt such that the main body and bib panels collectively define a child carrying area of the carrier. The carrier further comprises a pair of shoulder straps which are extensible over the wearer's shoulders, and each have opposed first and second end portions coupled to respective, prescribed regions of the main body and bib panels. The conversion flaps are selectively transitional between a stowed or narrow configuration, wherein free end portions of the conversion flaps are releasably attached to each other, and a deployed or wide configuration wherein the free end portions of the conversion flaps are releasably attached to the waist belt.

Each of the conversion flaps includes an elongate slot and an adjacent fastener (e.g., a conversion snap) disposed at the free end portion thereof. Each slot is adapted to accommodate a respective one of a pair of toggles attached to the waist belt at or proximate to the top edge thereof. The receipt of the toggles into corresponding ones of the slots effectively maintains the conversion flaps in the wide configuration. Conversely, the removal of the toggles from within the slots allows the conversion flaps to be folded inwardly toward each other in overlapping relation to the central portion of the main body panel. In this folded state, the conversion snaps (one male, one female) of the conversion flaps may be releasably attached to each other as effectively maintains the conversion flaps in the narrow configuration.

In the infant carrier, the head portion of the main body panel is foldable relative to the remainder thereof from an extended state to a folded state. When in the folded state, the head portion at least partially overlaps the outer surface of the central portion.

The infant carrier further comprises a spaced pair of side triangles, each of which is attached to a portion of a respective side edge of the bib panel and a portion of the top edge of the waist belt so as to overlap and underlie a respective one of the conversion flaps when in its wide configuration. In this regard, the side triangles provide an aesthetic integration effect between the waist belt and the bib panel and, to a lesser extent, a cushioning effect for the upper thighs of a child positioned within the carrier irrespective of whether the conversions flaps are in the wide or narrow configuration.

The infant carrier further comprises a pair of leg loops which are attached to respective ones of the opposed side edges of the bib panel in spaced relation to the top edge of the waist belt. The leg loops are selectively, releasably attachable to respective ones of a corresponding pair of fasteners (e.g., buttons) disposed on the outer surface of the main body panel. The leg loops, when attached to the buttons, create prescribed attachment points between corresponding side edges of the main body and bib panels, and facilitate the formation of a spaced pair of comparatively smaller leg openings between the leg loops and the waist belt.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
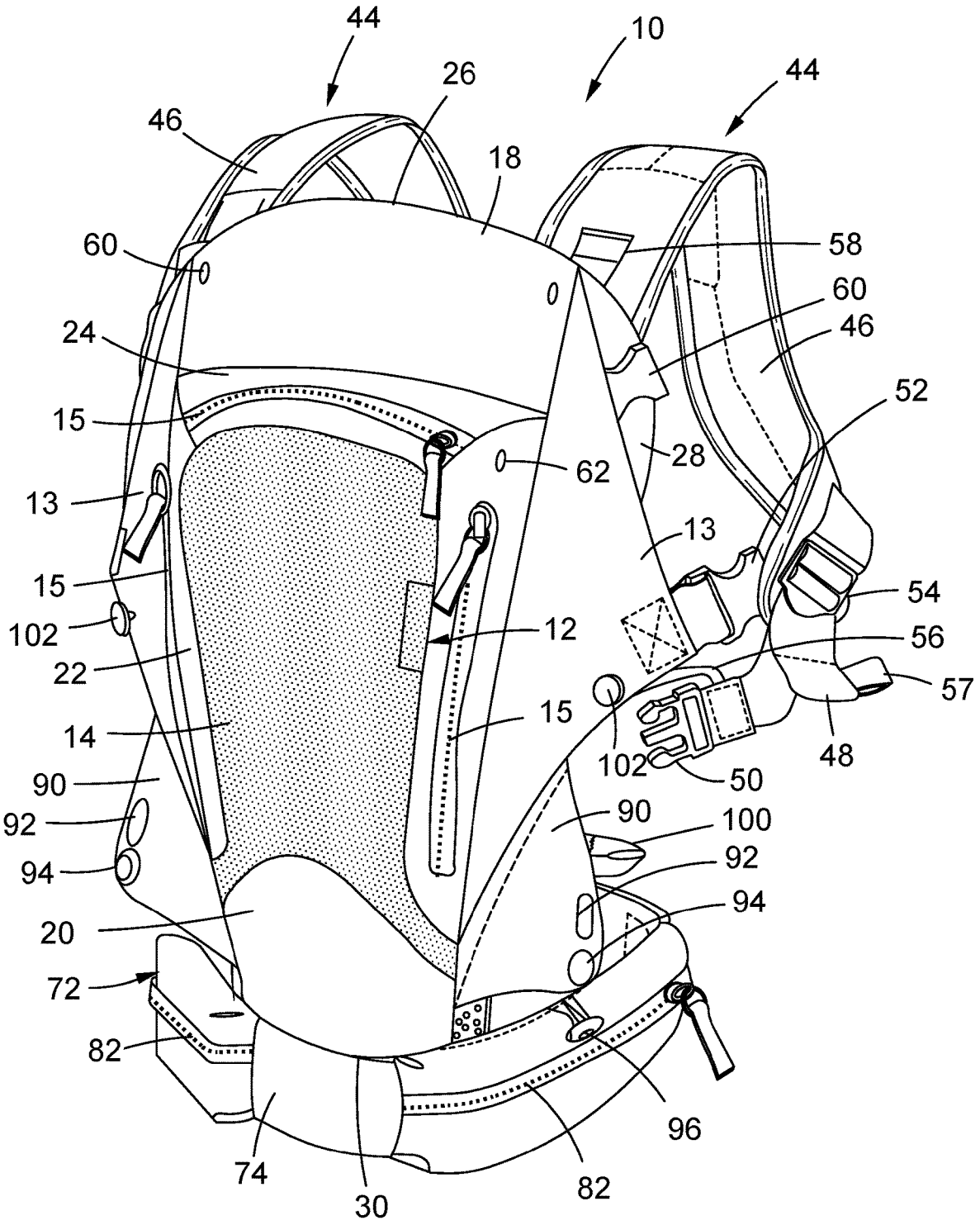
FIG. 1 is a front view of an adjustable infant carrier constructed in accordance with the present disclosure, the conversion flaps of the infant carrier being shown in a wide arrangement or configuration, though not being attached to the waist belt of the carrier.

Referring now to the drawings, wherein the showings are for purposes of illustrating one embodiment of the present disclosure only, and not for purposes of limiting the same, there is depicted an adjustable infant carrier 10 constructed in accordance with the present disclosure. The infant carrier 10 is specifically configured and adapted to provide enhanced adjustability and ease-of-use relative to conventional infant carriers. More specifically, the infant carrier 10 is outfitted with structural features described with particularity below which are adapted to allow for adjustability to the effective width of the seat portion of the carrier so as to accommodate children of differing size, as well as different support positions/configurations. The infant carrier 10 is additionally configured to be worn in both front and back carry configurations.

Referring now to the FIGS. 1-4, the carrier 10 comprises a main body panel 12 defining an exteriorly presented outer surface 14, and an opposed, interiorly presented inner surface 16. When viewed from the perspective shown in FIGS. 1 and 2, the main body panel 12 further defines a head portion 18, a seat portion 20, and a central portion 22 which extends between the head and seat portions 18, 20. Approximately the lower third of the main body panel 12 defines the seat portion 20 thereof, the use of which will be described in more detail below. A fold seam 24 defines the transition between the head and central portions 18, 22. The head portion 18 defines an arcuately contoured, generally convex top edge segment 26. The opposed ends of this top edge segment 26 transition into each of an opposed pair of non-linear side edge segments 28 of the main body panel 12. A bottom edge segment 30 of the main body panel 12 is defined by the seat portion 20 thereof, with the side edge segments 28 extending between the top and bottom edge segments 26, 30.

In the carrier 10, the main body panel 12 is partially defined by an opposed pair of wing portions 13 thereof. Each of the wing portions 13 has a generally triangular configuration. As viewed from the perspective shown in FIG. 1, the outer surface of each of the wing portions 13 defines a portion of the overall outer surface 14 of the main body panel 12, with the top end of each wing portion 13 extending to approximately the top edge segment 26 of the main body panel 12, and the opposite bottom end of each wing portion 13 extending to approximately the transition between the seat and central portions 20, 22 of the main body panel 12. For each wing portion 13, one of the three side edge segments thereof is secured to the remainder of the main body panel 12 in a lengthwise direction, with the remaining two free side edge segments meeting at an approximate apex, those free side edge segments of the wing portions 13 which are not secured to the remainder of the main body panel 12 being separate from the side edge segments 28 defined thereby.

It is contemplated that in the carrier 10, the main body panel 12 may be constructed to define one or more exteriorly presented zippered pockets 15. As shown in FIG. 1, in an exemplary implementation of the carrier 10, three (3) pockets 15 are included in the main body panel 12. From the perspective shown in FIG. 1, one of these pockets 15 extends generally horizontally underneath and in relative close proximity to the fold seam 24. The two remaining pockets 15 each extend generally vertically along respective ones of those side edge segments of the wing portions 13 which are secured to the remainder of the main body panel 12.

The carrier 10 further comprises a bib panel 32 which defines an outer surface 34, and an opposed inner surface (not shown) which, in the carrier 10, faces the inner surface 16 of the main body panel 12. In this regard, the main body and bib panels 12, 32, and in particular the inner surfaces defined thereby, collectively form a pouch-like infant or child carrying area of the carrier 10, the bib panel 32 effectively creating a barrier between at least part of that infant carrying area and the chest or back of the wearer. When viewed from the perspective shown in FIG. 2, the bib panel 32 further defines an arcuately contoured, generally concave top edge segment 36, the opposed ends of which terminate at respective ones of the spaced pair of corner regions 38 also defined by the bib panel 32. The bib panel 32 also defines a bottom edge segment 40, and an opposed pair of side edge segments 42 which extend between the bottom edge segment 40 and respective ones of the corner regions 38.

The carrier 10 further comprises an identically configured pair of shoulder straps 44 which are adapted to be extensible over respective ones of the wearer's shoulders. Each of the shoulder straps 44 preferably has a two-piece construction. In greater detail, each of the shoulder straps 44 comprises a primary segment 46 which is of a relatively wide and relatively thick padded construction, preferably fabricated from two opposed layers of a soft yet durable fabric material having a padded layer therebetween, the peripheral edges of the fabric layers being secured to each other through the use of stitching. As is most apparent from FIG. 2, one end portion of the primary segment 46 of each shoulder strap 44 is attached to a respective one of the corner regions 38 of the bib panel 22.

In addition to the primary segment 46, each shoulder strap 44 includes a secondary segment 48 which is of a narrower and thinner construction (e.g., webbing) in comparison to the corresponding primary segment 46. Within each shoulder strap 44, one end portion of the secondary segment 48 is attached to that end portion of the corresponding primary segment 46 opposite the end portion attached to a respective one of the corner regions 38 of the bib panel 32. As best seen in FIG. 1, the opposite end portion of the secondary segment 48 is operatively coupled to a fastener 50 (e.g., a male buckle) which is releasably attachable to a complementary, corresponding fastener 52 (e.g., a female buckle) itself attached to and protruding from a corresponding one of the wing portions 13 of the main body panel 12 proximate the apex of such wing portion 13. The attachment of the primary and secondary segments 46, 48 of each shoulder strap 44 to each other, and to the bib panel 32, is preferably facilitated through the use of stitching. As further seen in FIG. 1, the secondary segments 48 each have a side support adjuster 54 integrated therein that allows for the adjustability in the length of the corresponding shoulder strap 44 relative to the main body and bib panels 12, 32.

Figure 2:
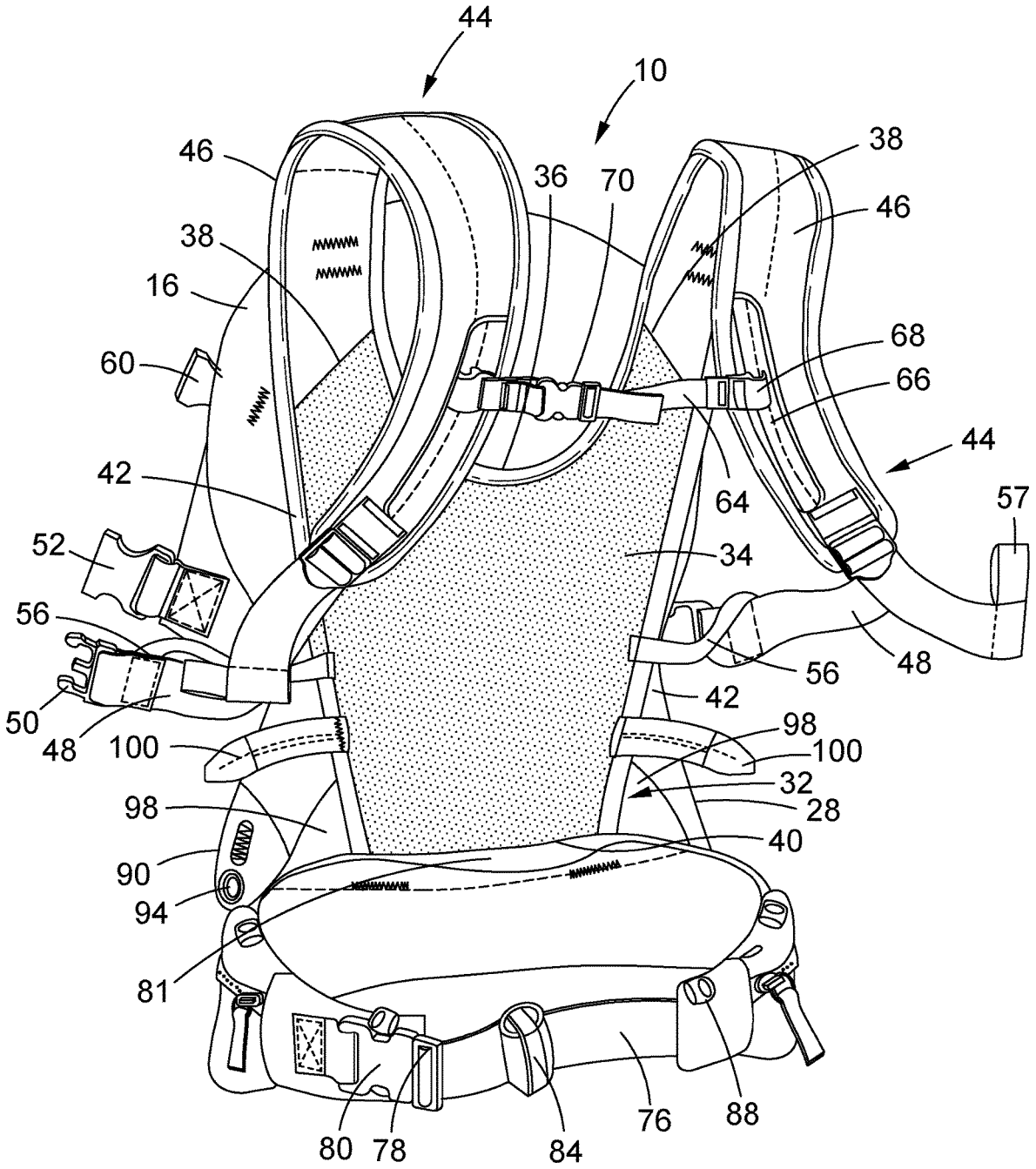
FIG. 2 a rear view of the infant carrier shown in FIG. 1, the conversion flaps of the infant carrier being shown in a wide configuration though not being attached to the waist belt of the carrier.
Figure 3:
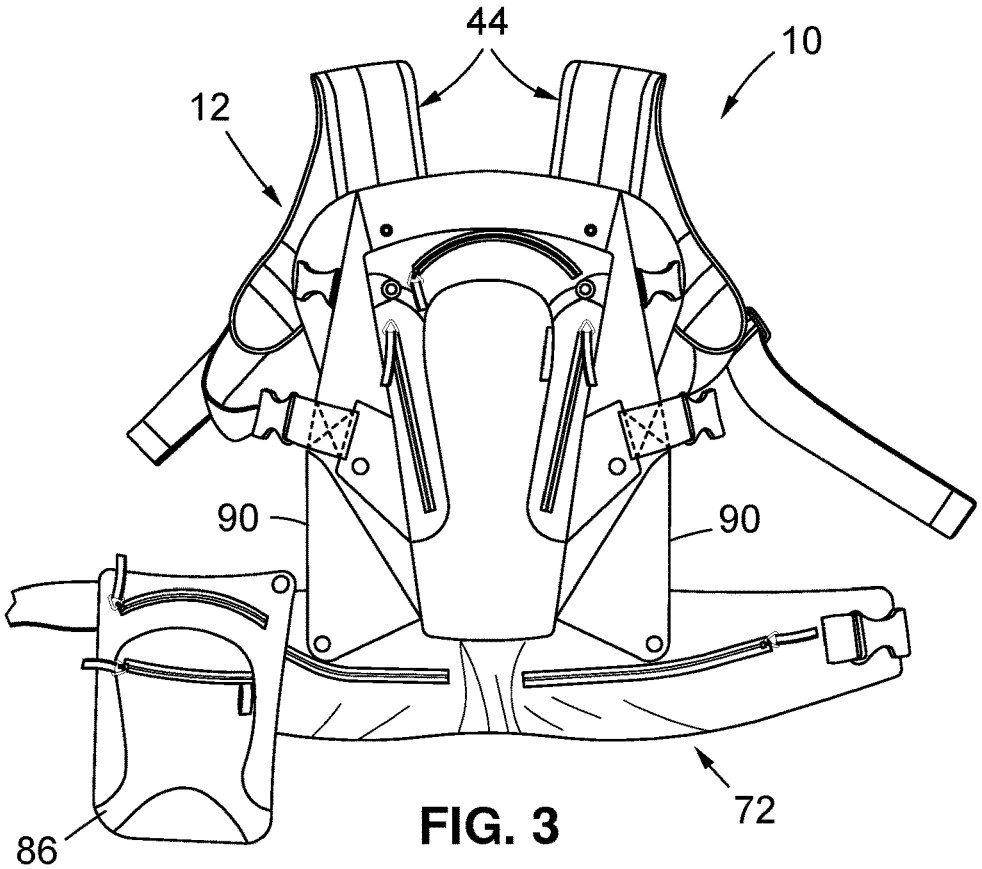
FIG. 3 is a front view of the infant carrier similar to FIG. 1, the conversion flaps of the infant carrier being shown in a wide configuration as attached to the waist belt of the carrier.
Figure 4:
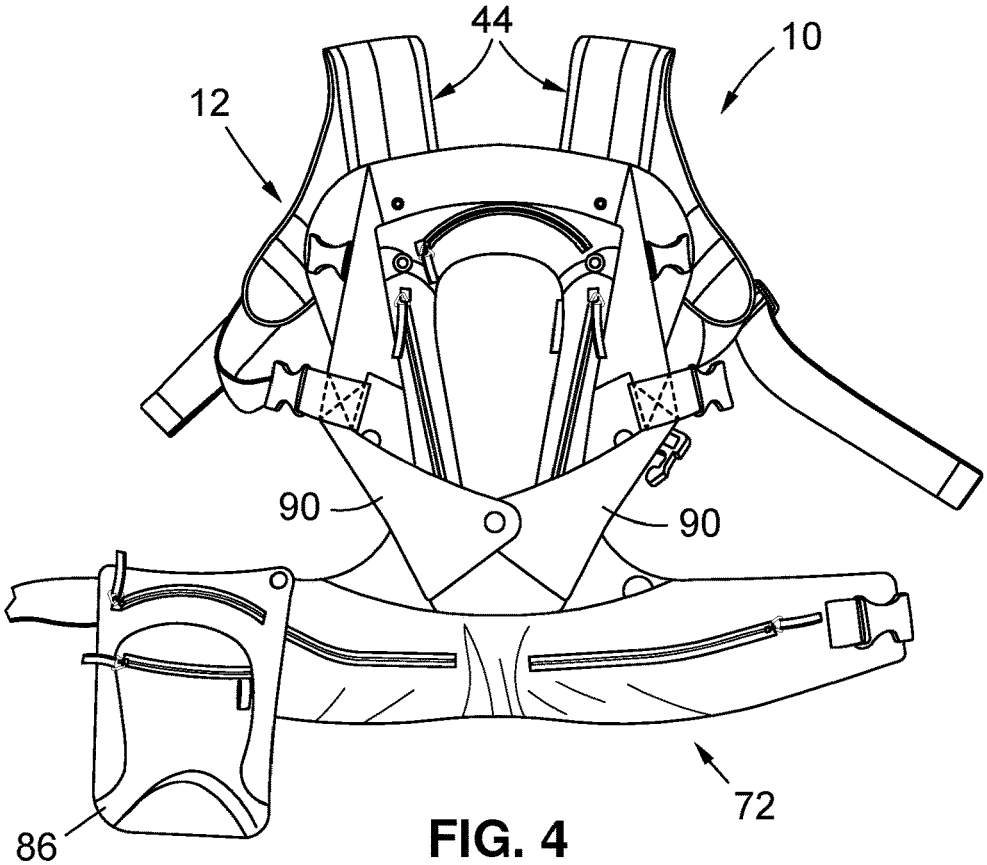
FIG. 4 is a front view of the infant carrier, the conversion flaps of the infant carrier being shown in a narrow configuration as attached to each other.

In the carrier 10, though the secondary segment 48 of each shoulder strap 44 is releasably attachable to the main body panel 12 in the aforementioned manner through the use of a corresponding pair of the mating fasteners 50, 52, such secondary segment 48 is permanently tethered to a respective one of the side edge segments 42 of the bib panel 32. In greater detail, as best seen in FIG. 2, the carrier 10 further comprises a pair elastic tether straps 56, each of which is permanently attached to, and extends between, a respective one of the secondary strap segments 48 and a corresponding one of the side edge segments 42 of the bib panel 32. As will be recognized, the tether straps 56 function to maintain the secondary strap segments 48 of the shoulder straps 44 in a loose, resilient state of attachment to the bib panel 32 even when the secondary strap segments 48 are disengaged from the main body panel 12 as a result of the detachment of each of the two corresponding pairs of fasteners 50, 52 from each other. By maintaining this state of engagement, the carrier 10 is more easily operatively positioned on and secured to the wearer, in comparison to what would otherwise transpire if the shoulder straps 44 were not permanently tethered to the bib panel 32. In this regard, the tether straps 56 effectively maintain each of the shoulder straps 44 in a closed-loop configuration relative to the bib panel 32 even when the secondary strap segments are detached form the wing portions 13 of the main body panel 12.

It is also contemplated that in the carrier 10, the secondary segment 48 of each of the shoulder straps 44 may be outfitted with a storage loop 57. The storage loop 57 is adapted to accommodate a portion of the secondary segment 48 of the same or other remaining shoulder strap 44 for the compact, efficient storage thereof.

In the carrier 10, the primary segment 46 of each shoulder strap 44, in addition to being permanently attached to a respective one of the corner regions 38 of the bib panel 32 in the aforementioned manner, is also releasably attachable to the main body panel 12, and in particular to the head portion 18 of the main body panel 12. In greater detail, the carrier 10 further comprises a pair of head support straps 58. One end portion of each of the head support straps 58 is permanently attached to a central portion of a respective one of the primary segments 46 through, for example, the use of stitching. The opposite end portion of each head support strap 58 is operatively coupled to a fastener (e.g., a male buckle) which is releasably attachable to a complementary, corresponding fastener 60 (e.g., a female buckle) itself attached to and protruding from the outer surface of the main body panel 12 to one side of the head portion 18 thereof, in the manner best seen in FIG. 1. Though not shown, the head support straps 58 each have a head support adjuster integrated therein that allows for the adjustability in the length of the corresponding head support strap 58, and hence the level of support provided by the head portion 18 of the main body panel 12 to the head of an infant being carried within the carrier 10.

Referring again to FIG. 1, disposed on the outer surface 14 of the main body panel 12 on the head portion 18 thereof and proximate to the top edge segment 26 is an identically configured, horizontally aligned pair of connectors 60 (e.g., male snaps). In addition, disposed on the outer surface 14 of the main body panel 12 on the central portion 22 thereof is an identically configured, horizontally aligned pair of connectors 62 (e.g., female snaps). Each of the connectors 60 is adapted to be releasably engageable to a respective one of the connectors 62. In the carrier 10, the head portion 18 is adapted to be selectively folded along the fold seam 24 to transition from its extended state (shown in FIGS. 1-4) to a folded state. The head portion 18 is maintainable in its folded state by the releasable engagement of the connectors 60 to respective ones of the connectors 62. When the head portion 18 is in its folded state, at least a portion of the outer surface 14 of the main body panel 12 as defined by the head portion 18 is directed toward or faces a portion of the outer surface 14 of the main body panel 12 as defined by the central portion 22, with a portion of the inner surface 16 of the main body panel 12 thus being outwardly or exterior presented. As will be recognized by those of ordinary skill in the art, the positioning of the head portion 18 of the main body panel 12 in its extended state provides a greater measure of support to the head of an infant carried within the carrier 10.

The carrier 10 is further provided with a cross strap 64 which extends between and selectively interconnects the shoulder straps 44. In greater detail, the primary segment 46 of each shoulder strap 44 includes an elongate, bead or cord-like segment 66 which protrudes from the exterior surface thereof, and extends partially there along in a lengthwise direction. The opposed ends of the cross strap 64 are each outfitted with a slide coupler 68 which is cooperatively engaged to and slidably positionable along the length of a respective one of the segments 66. As will be recognized by those of ordinary skill in the art, the cooperative engagement of the cross strap 64 to each of the shoulder straps 44 via the engagement of the slide couplers 68 to respective ones of the segments 66 allows for variability or adjustability in the positioning of the cross strap 64 relative to the shoulder straps 44. The cross strap 64 preferably includes a buckle 70 comprising male and female connectors integrated therein. As will be recognized, the detachment of the male and female connectors of the buckle 70 from each other effectively separates the cross strap 64 into two independent segments coupled to respective ones of the primary segments 46 via respective ones of the slide couplers 68.

Securing the male and female connectors of the buckle 70 to each other as facilitates the continuous extension of the cross strap 64 between the shoulder straps 44 assists in maintaining the shoulder straps 44, and in particular the primary segments 46 thereof, in a relatively fixed spatial relationship relative to each other. The manner in which the buckle 70 is integrated into the cross strap 64 allows for adjustability in the fixed length of the cross strap 64 as it extends between the primary segments 46 of the shoulder straps 44.

The carrier 10 further comprises an elongate waist belt 72 which it is extensible about the waist of a wearer. The waist belt 72 preferably comprises a primary belt segment 74 which is of a relatively wide and relatively thick padded construction, preferably fabricated from two opposed layers of the soft yet durable fabric material having a padded letter therebetween, the peripheral edges of the fabric layers being secured to each other through the use of stitching. The waist belt 72 also includes a secondary belt segment 76 which is attached to and protrudes from one end portion of the primary belt segment 74, and is of a narrower and thinner construction (e.g., webbing) in comparison to the primary belt segment 74. Attached to and selectively positionable along the length of the secondary belt segment 76 is a fastener 78 (e.g., a male buckle) which is releasably engageable to a complementary fastener 80 (e.g., a female buckle) attached to that end portion of the primary belt segment 74 opposite that having the secondary belt segment 76 protruding therefrom. As will be recognized, the coupling of the fasteners 78, 80 to each other effectively maintains the waist belt 72 in a closed-loop configuration, the circumference of which can be selectively increased or decreased through the adjustments of the positioning of the fastener 78 on the secondary belt segment 76.

In the carrier 10, both the main body and bib panels 12, 32 are permanently attached to the waist belt 72, with the use of stitching being an exemplary attachment modality. In greater detail, it is contemplated that the bottom edge segment 30 defined by the seat portion 20 of the main body panel 12, and the bottom edge segment 40 defined by the bib panel 32, will each be operatively coupled to the waist belt 72 at or in relative close proximity to the top edge segment defined by the primary belt segment 74 thereof, as viewed from the perspective shown in FIGS. 1-4. With such attachment, the main body and bib panels 12, 32 collectively define a child carrying area of the carrier. In this regard, as indicated above, the main body and bib panels 12, 32 as attached to the primary belt segment 74 of the waist belt 72, and in particular the inner surfaces defined by the main body and bib panels 12, 32, collectively form a pouch-like infant or child carrying area of the carrier 10, the bib panel 32 effectively creating a barrier between at least part of that infant carrying area and the chest or back of the wearer. As seen in FIG. 2, a yolk 81 is located at and extends along intersection between the top edge segment of the primary belt segment 74 and the bottom edge segment 30 of the main body panel 12, the yolk 81 providing support for that region of the carrier 10 which is positioned on the waist of the wearer.

The primary belt segment 74 of the waist belt 72 in the carrier 10 may be constructed to define one or more exteriorly presented zippered pockets 82. As shown in FIG. 1, in an exemplary implementation of the carrier 10, two (2) pockets 82 are included in the waist belt 72. From the perspective shown in FIG. 1, these pockets 82 each extend generally horizontally in aligned relation to each other, and are separated from each other by a central section of the primary belt segment 74 which is centrally located underneath the seat portion 20 of the main body panel 12. The secondary belt segment 76 may optionally be outfitted with a storage loop 84. The storage loop 84 is adapted to accommodate a portion of the secondary belt segment 76 for the compact, efficient storage thereof. Still further, it is also contemplated that waist belt 72, and in particular the primary belt segment 74 thereof, may optionally be outfitted with an accessory pouch 86, shown in FIGS. 3 and 4. The pouch 86, if included in the carrier 10, is adapted to be releasably attachable to either of a plurality of pouch attachment members 88 which are attached to the primary belt segment 74 proximate to the top edge segment thereof in spaced relation to each other.

The carrier 10 further comprises a pair of generally triangular conversion flaps 90 which protrude from the seat and central portions 20, 22 of the main body panel 12 in opposed relation to each other. The conversion flaps 90 are selectively transitional between a stowed or narrow configuration (shown in FIG. 4), wherein free end portions of the conversion flaps 90 are releasably attached to each other, and a deployed or wide configuration (shown in FIG. 3) wherein the free end portions of the conversion flaps 90 are releasably attached to the waist belt 72, and in particular the primary belt segment 74 thereof.

In greater detail, each of the conversion flaps 90 generally defines three (3) side edge segments, with one such side edge segment being attached to and protruding from a respective one of the side edge segments 28 of the main body panel 12, an exemplary attachment modality being the use of stitching. Each of the conversion flaps 90 includes an elongate slot 92 and an adjacent fastener 94 (e.g., a conversion snap) disposed at the free end portion thereof which is defined approximately at the apex between those two remaining side edge segments not secured to the main body panel 12. Each slot 92 is adapted to accommodate a respective one of a pair of fasteners 96 (e.g., toggles) which are each attached to the primary belt segment 74 of the waist belt 72 in spaced relation to each other at or proximate to the top edge segment of the primary belt segment 74. The receipt of the fasteners 96 into corresponding ones of the slots 92 effectively maintains the conversion flaps 90 in the wide configuration.

Conversely, the removal of the fasteners 96 from within the slots 92 allows the conversion flaps 90 to be folded inwardly toward each other in overlapping relation to the outer surface 14 of the main body panel 12 at the central portion 22 thereof. In this folded state, the fasteners 94 (one male, one female) of the conversion flaps 90 may be releasably attached to each other as effectively maintains the conversion flaps 90 in the narrow configuration.

The infant carrier 10 further comprises a spaced pair of side triangles 98. Of the three side edge segments defined by each of the side triangles 98, one such side edge segment is attached to a portion of a respective side edge segment of the bib panel 32, with another side edge segment of the same side triangle being attached to a portion of the top edge segment of the primary belt segment 74 of the waist belt 72. With this attachment, each of the side triangles 98 overlaps and underlies a respective one of the conversion flaps 90 when in its wide configuration. In this regard, the side triangles 98 provide an aesthetic integration effect between the waist belt 72 and the bib panel 32 and, to a lesser extent, a cushioning effect between the upper thighs of an infant positioned within the carrier 10 and the wearer irrespective of whether the conversions flaps 90 are in the wide or narrow configuration.

The infant carrier 10 further comprises a pair of elongate leg loops 100 which are attached to respective ones of the opposed side edge segments 42 of the bib panel 32 in spaced relation to the top edge segment of the primary belt segment 74 of the waist belt 72. The leg loops 100 are selectively, releasably attachable to respective ones of a corresponding pair of fasteners 102 (e.g., buttons) disposed on the outer surface 14 of the main body panel 12. In greater detail, the fasteners 102 are located on the outer surfaces of respective ones of the wing portions 13 of the main body panel 12 in close proximity to the apex defined by the corresponding wing portion 13.

In the carrier 10, the attachment of the secondary segments 48 of the shoulder straps 44 to the wing portions 13 of the main body panel 12 via the fasteners 50, 52 facilitates the formation of an opposed pair of leg opening for the infant positioned within the carrier 10. These leg opening are generally disposed between the secondary segments and the waist belt 72. However, in the event these leg opening are too large for a small infant, the leg loops 100 are provided in the carrier 10 to facilitate the creation of smaller leg openings. In this regard, when attached to the fasteners 102, the leg loops 100 create prescribed attachment points between the side edge segments of the wing portions 13 (and hence the main body panel 12) and corresponding side edge segments 42 of the bib panel 32, thus facilitating the formation of a spaced, comparatively smaller pair of leg openings between the leg loops 100 and the waist belt 72. Typically, the leg loops 100 will be deployed to facilitate the formation of these smaller leg openings when the conversion flaps 90 are in the narrow or wide configurations to provide a safeguard for a smaller infant being carried within the carrier 10, assisting in preventing the infant from being able to slip out from between the main body and bib panel 12, 32.

In the carrier 10, the main body panel 12 is preferably fabricated from two opposed layers of a soft yet durable fabric material, the peripheral edges of which are secured to each other through the use of stitching. Additionally, a padded layer is interposed between prescribed areas of these fabric layers. Additionally, those of ordinary skill in the art that attachment modalities other than for snaps, buckles, toggles, slots, zippers, buttons and button holes may be substituted for the various fasteners/attachment modalities described above without departing from the spirit and scope of the present invention.

Based on the structure of the infant carrier 10 as described above, it is suitable for use in a variety of different configurations. In greater detail, the infant carrier 10 is suitable for use in a front carry configuration with the infant facing the wearer's chest or facing outward (narrow conversion flap 90 position and head portion 18 folded down), and in a rear carry configuration with the infant facing the wearer's back. In either of the front or rear carry configurations, it is contemplated that seat portion 20 of the main body panel 12 will at least partially overhang or be draped over the waist belt 72, with the weight of the infant being transferred not only into the waist belt 72 for distribution into the wearer's hips, but also into the shoulder straps 44 for distribution into each of the wearer's shoulders. In either of these carrying configurations, the effective width of the seat portion 20 can be selectively increased or decreased by the manipulation of the conversion flaps 90 into either of the aforementioned narrow or wide configurations. As also previously explained, if warranted by the small size of the infant, the leg loops 100 may also be used for purposes of defining the aforementioned smaller leg openings. Still further, the head portion 18 of the main body panel 12 may be selectively manipulated between its extended and folded states in the aforementioned manner as may be need to properly support the head of the infant within the carrier 10. Because they are outfitted with the length adjusting modalities described above, the effective lengths of both the shoulder straps 44 and the waist belt 72 may be selectively increased or decreased as needed to achieve a proper fit of the carrier 10 to the wearer based not only on the wearer's physical attributes, but those of the infant to be carried as well. In this regard, as will be recognized, the adaptability of the carrier 10 to the infant's physical features is further enhanced by the width adjustability of the seat portion 20, as well as the optional deployment of the leg loops 100 and the folding/unfolding of the head portion 18 of the main body panel 12.

Those of ordinary skill in the art will also recognize that the carrier 10 may be outfitted with a shoulder strap arrangement differing from that described above without necessarily departing from the spirit and scope of the present invention. By way of example, the carrier 10 may include a shoulder strap arrangement wherein, by virtue of the elimination of the bib panel 32, those end portions of the primary segments 46 attached to the corner regions 38 of the bib panel 32 are instead attached directly to the main body panel 12 proximate prescribed regions along the top edge segment 26 thereof. In another variant wherein the bib panel 32 is also potentially eliminated, those end portions of the primary segments 46 attached to the corner regions 38 of the bib panel 32 are instead attached directly to the waist belt 72 proximate to the top edge segment of the primary belt segment 74 thereof.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An adjustable infant carrier wearable by a user for carrying an infant, the infant carrier comprising:

a main body panel at least partially defining a seat portion;

a bib panel disposed in at least partially overlapping relation to the main body panel;

a pair of conversion flaps attached to and protruding from the main body panel in opposed relation to each other;

a waist belt extensible about the waist of a wearer, portions of the main body and bib panels being attached to the waist belt so as to collectively define an infant carrying area of the carrier; and a pair of shoulder straps extensible over the shoulders of the wearer and each operatively coupled to the main body and bib panels;

the conversion flaps being selectively positionable in a narrow configuration wherein they are releasably attached to each other in overlapping relation to a portion of the main body panel and to each other, and a wide configuration wherein they are releasably attached to prescribed portions of the waist belt.

2. The adjustable infant carrier of claim 1, further comprising:

a pair of leg loops attached to and protruding from the bib panel in opposed relation to each other;

each of the leg loops being selectively, releasably attachable to the main body panel to facilitate the formation of a spaced pair of leg openings between the leg loops and the waist belt.

3. The adjustable infant carrier of claim 1, wherein the main body panel defines a head portion which is foldable relative to the remainder thereof from an extended state to a folded state, the head portion at least partially overlapping the remainder of the main body panel when in the folded state.

4. The adjustable infant carrier of claim 1, further comprising a spaced pair of side triangles, each of which is attached to portions of the bib panel and the waist belt so as to overlap and underlie a respective one of the conversion flaps when in its wide configuration.

5. The adjustable infant carrier of claim 1, wherein each of the shoulder straps comprises opposed first and second ends portions which are each coupled to respective, prescribed regions of the main body and bib panels.

6. The adjustable infant carrier of claim 5 wherein:

the main body panel includes an opposed pair of wing portions;

the bib panel has a top edge defining a spaced pair of corner regions;

the first end portion of each of the shoulder straps is attached to a respective one of the corner regions; and the second end portion of each of the shoulder straps is releasably attached to a respective one of the wing portions.

7. The adjustable infant carrier of claim 6, wherein the first and second end portions of each of the shoulder straps are disposed on a common side of an axis which extends between and separates the opposed pair of wing portions of the main body panel from each other.

8. The adjustable infant carrier of claim 1, wherein:

each of the conversion flaps has a generally triangular configuration including an apex collectively defined by a pair of side edge segments thereof which are not secured to the main body panel; and each of the conversion flaps includes a slot formed therein and a fastener disposed thereon.

9. The adjustable infant carrier of claim 8, wherein the waist belt includes a spaced pair of toggles attached thereto which are selectively advanceable through respective ones of the slots to maintain the conversion flaps in the wide configuration.

10. An adjustable infant carrier wearable by a user for carrying an infant, the infant carrier comprising:

at least a main body panel at least partially defining a seat portion;

a pair of conversion flaps attached to and protruding from the main body panel in opposed relation to each other;

a waist belt extensible about the waist of a wearer, a portion of the main body panel being attached to the waist belt so as to at least partially define an infant carrying area of the carrier; and a pair of shoulder straps extensible over the shoulders of the wearer and each operatively coupled to the main body panel;

the conversion flaps being selectively positionable in a narrow configuration wherein they are releasably attached to each other in overlapping relation to a portion of the main body panel and to each other, and a wide configuration wherein they are releasably attached to prescribed portions of the waist belt.

11. The adjustable infant carrier of claim 10, wherein the main body panel defines a head portion which is foldable relative to the remainder thereof from an extended state to a folded state, the head portion at least partially overlapping the remainder of the main body panel when in the folded state.

12. The adjustable infant carrier of claim 10 wherein:

the main body panel includes an opposed pair of wing portions; and one of opposed first and second end portions of each of the shoulder straps is releasably attached to a respective one of the wing portions.

13. The adjustable infant carrier of claim 12, wherein the first and second end portions of each of the shoulder straps are disposed on a common side of axis which extends between and separates the opposed pair of wing portions of the main body panel from each other.

14. The adjustable infant carrier of claim 10, wherein:

each of the conversion flaps has a generally triangular configuration including an apex collectively defined by a pair of side edge segments thereof which are not secured to the main body panel; and each of the conversion flaps includes a slot formed therein and a fastener disposed thereon.

15. The adjustable infant carrier of claim 14, wherein the waist belt includes a spaced pair of toggles attached thereto which are selectively advanceable through respective ones of the slots to maintain the conversion flaps in the wide configuration.

16. An adjustable infant carrier wearable by a user for carrying an infant, the infant carrier comprising:

a main body panel;

a bib panel disposed in at least partially overlapping relation to the main body panel;

a pair of conversion flaps attached to and protruding from the main body panel in opposed relation to each other;

a waist belt extensible about the waist of a wearer, at least a portion of the main body panel being attached to the waist belt so as to at least partially define an infant carrying area of the carrier; and a pair of shoulder straps extensible over the shoulders of the wearer and each operatively coupled to the main body and bib panels;

the conversion flaps being selectively positionable in a narrow configuration wherein they are releasably attached to each other in overlapping relation to a portion of the main body panel and to each other, and a wide configuration wherein they are releasably attached to prescribed portions of the waist belt.

17. The adjustable infant carrier of claim 16, further comprising a spaced pair of side triangles, each of which is attached to portions of the bib panel and the waist belt so as to overlap and underlie a respective one of the conversion flaps when in its wide configuration.

18. The adjustable infant carrier of claim 16, wherein each of the shoulder straps comprises opposed first and second ends portions which are each coupled to respective, prescribed regions of the main body and bib panels.

19. The adjustable infant carrier of claim 18 wherein:

the main body panel includes an opposed pair of wing portions;

the bib panel has a top edge defining a spaced pair of corner regions;

the first end portion of each of the shoulder straps is attached to a respective one of the corner regions; and the second end portion of each of the shoulder straps is releasably attached to a respective one of the wing portions.

20. The adjustable infant carrier of claim 19, wherein:

each of the conversion flaps has a generally triangular configuration including an apex collectively defined by a pair of side edge segments thereof which are not secured to the main body panel; and each of the conversion flaps includes a slot formed therein and a fastener disposed thereon.

* * * * *